United States Patent [19]

Colombani et al.

[11] Patent Number: 4,773,764

[45] Date of Patent: Sep. 27, 1988

[54] PREPARATION OF ADHESIVE COMPOUNDS FOR MINERAL FIBER FELTS

[75] Inventors: Jean-Marc Colombani, Clermont; Michel Hardouin, Cambronne Les Clermont, both of France

[73] Assignee: Isover Saint-Gobain, Courbevoie, France

[21] Appl. No.: 911,662

[22] Filed: Sep. 25, 1986

[30] Foreign Application Priority Data

Sep. 25, 1985 [FR] France ..... 8514182

[51] Int. Cl.[4] ..... B01F 15/00

[52] U.S. Cl. ..... 366/150; 137/563; 366/160; 366/137

[58] Field of Search ..... 366/132, 136, 137, 138, 366/142, 151, 153, 159, 160, 161, 162, 163, 150; 137/563

[56] References Cited

U.S. PATENT DOCUMENTS

| | | | |
|---|---|---|---|
| 2,963,525 | 12/1960 | Folz | 366/137 |
| 3,031,271 | 4/1962 | Weinbrenner | 366/138 |
| 3,271,241 | 9/1966 | Mumme | 366/153 |
| 3,897,939 | 8/1975 | Hostettler | 366/137 |

*Primary Examiner*—Robert W. Jenkins

*Attorney, Agent, or Firm*—Oblon, Fisher, Spivak, McClelland & Maier

[57] ABSTRACT

The preparation of adhesive compounds for mineral fiber felts, involves combining and mixing several constituents in the liquid state. These constituents are taken to a preparation container (12) using one or several conduits (13) the number of which is smaller than the number of constituents, with each conduit (13) being connected by one or several valves (10) to constituent feed equipment, with each valve (10) controlling the sequential introduction of a constituent into a conduit (13), with a mass flow meter-type device being placed on each conduit (13), downstream from the valves (10), with the compound prepared subsequently passing from the preparation container (12) to a utilization circuit.

6 Claims, 2 Drawing Sheets

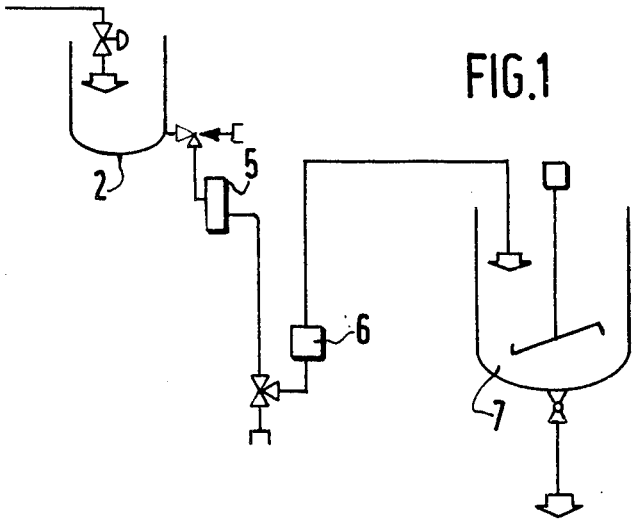
FIG.1
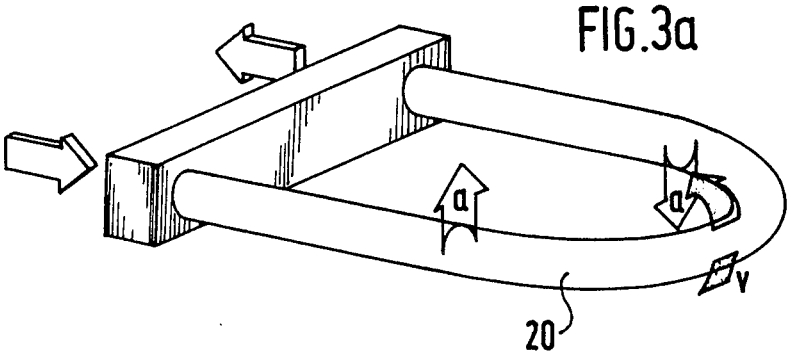
FIG.3a
FIG.3b
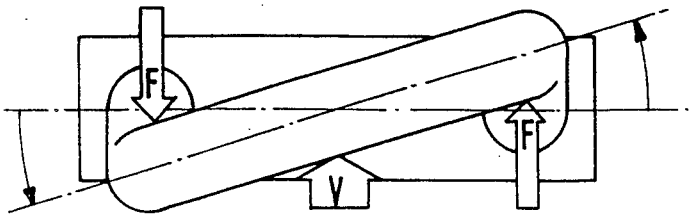

PREPARATION OF ADHESIVE COMPOUNDS FOR MINERAL FIBER FELTS

BACKGROUND OF THE INVENTION

1. Field of the Invention

The invention pertains to the preparation of adhesive compounds intended to be sprayed on mineral fibers constituting fleeces or felts, especially for thermal and acoustic insulation. These compounds give the felts which are formed their cohesion and, in a more general manner, their mechanical properties. The compounds in question can vary quite appreciably depnding on the purpose of the felts, even when, as in the most common forms, the base resin for these compounds is still the amino plastic, phenolic plastic and especially formophenolic (amine modified or otherwise) type.

2. Background of the Prior Art

In addition to the resin, in general, the compound which is sprayed on the fibers thus traditionally comprises various ingredients which either improve the former's action or which add supplementary properties. In addition, it is known to add constituent in addition to the resin which also act as bonding agents. This is the case, for example, with carbamide or ammonium lignosulfonate. It is also customary to add an oil emulsion to the compound which acts as a softener and dustproofer. Certain glass-resin "coupling" agents are also added, which facilitate the bonding of the resin to the fibers. These include amino-silanes, for example. Filler materials, coloring, waterproofing agents such as silicones, etc. are also added.

A catalyst must also be added for the cross linkage of the resin which will promote the subsequent processing. Of course, this constituent cannot be added very long before the adhesive is applied to the fibers when its nature is such that it initiates an evolution towards cross linkage under surrounding conditions. Finally, in addition to the fact that the resin can run the risk of premature transformation if produced in very large quantities and increase the time periods between production and consumption (taking into account the proportion of water needed and the volume these compounds reach), it is preferably for reasons of storage convenience not to prepare the adhesive until immediately before it is used.

For example, it is generally preferable to limit storage time to a few hours. For some compounds, this period does not exceed 24 hours but can be shorter for certain compounds, for example, about 1 hour, or even less.

Moreover, products prepared on the same production line can quite often vary. In the hypothesis in which each adhesive would be prepared independently of immediate consumption, access to a complete range of adhesives would be necessary. This becomes less desirable as the variety of adhesives utilized increases.

For these reasons, the adhesives are usually prepared gradually as they are consumed. The problem is to ensure continuous preparation under economically satisfactory conditions. It is especially necessary to reduce operator intervention as much as possible. The cost of the special equipment used must also remain compatible with the economic objective established for the adoption of these techniques. In other words, simple solutions are needed which require a small number of personnel and moderate-cost equipment, while of course maintaining the quality of the adhesives prepared.

The traditional preparation method consists of placing the various constituents together in a tank, the proportions of which are measured by an operator when they are added. Taking into account the need for operator control, the preparation operations tend to be spaced and relatively large quantities are involved for each of these preparations. These two factors constitute an obstacle against frequent changes of the type of adhesive and require large storage capacities.

More recently, it was attempted to automate the preparation sequences allowing them to occur more frequently and thus involve smaller quantities.

It was proposed to prepare the adhesive compounds by adding the different constituents of the mixture using dosing pumps set to add these constituents in the required proportions. Even if it was proposed to prepare the compound continuously, as a direct function of its consumption, the most widespread solutions consist of making successive small-volume lots, with a previously prepared lot being consumed while the subsequent lot is being prepared.

A problem with this preparation method is related to the fact that the dosing pumps used must be very precise. Volumetric piston pumps are especially used. This equipment requires frequent maintenance. The equipment is also relatively expensive.

Moreover, the use of these volumetric pumps involves problems with respect to their automatic adjustment. It is known to modify their flow rate by changing the piston cycle or by modifying the operating speed, for example, but each of these methods involves its own problems. Speed modification, which is done especially using speed variators, does not allow a great degree of precision to be maintained over long periods of use. To modify the piston cycle, the pump must be connected to complex electromechanical equipment. For these reasons, the adjustment of prior equipment is rarely automated and operator intervention is limited by avoiding frequent production changes. But this obviously does not respond perfectly to practical needs.

An object of the invention is to propose a method for the preparation of the adhesive compound which is both reliable and precise, a preparation which is done in small quantities for each operation.

Another object of the invention is to propose such a method of preparation in which the constituents are measured preferably with a number of measuring devices which is smaller than the number of constituents used.

Another object of the invention is to allow the quantities of constituents utilized to be controlled instantaneously and automatically in the method for the preparation of the adhesive involved.

Another object of the invention is to allow an assessment of available compound to be prepared simultaneously so as to adjust the amount of compound being prepared to the quantity of felt of a given quality remaining to be prepared in the production sequence in progress. This assessment can also be combined with that of each of the constituents in stock to facilitate the management thereof.

Another object of the invention is to propose an installation which makes it possible to greatly reduce operator intervention for the adjustment of maintenance thereof.

SUMMARY OF THE INVENTION

According to the invention, the preparation apparatus for the adhesive compound comprises, in addition to storage tanks for the various constituents, a group of conduits and circulation pumps leading to valves connected to a single common conduit or to a limited number of common conduit(s) on which equipment to measure the mass of the product circulating in the conduit(s), is installed, with this (these) common conduit(s) carrying the constituents circulating sequentially to a preparation tank, in which the compound is prepared in definite quantities, then transferred by pumping into a distribution tank, from which it is finally taken by one or several pumps and sent to the device which sprays it on the fibers.

BRIEF DESCRIPTION OF THE DRAWINGS

The invention will now be described in detail, with reference to the drawings, in which:

FIG. 1 is a schematic view of a traditional assembly to supply the various constituents of the adhesive up to the preparation tank;

FIG. 3*a* is a diagram of the measuring device used in the installation according to the invention in a perspective view;

FIG. 3*b* illustrates a surface view of the phenomenon of bending which is the basis for the measurement using the device in FIG. 3*a*.

DETAILED DESCRIPTION OF THE INVENTION

Figure 2:
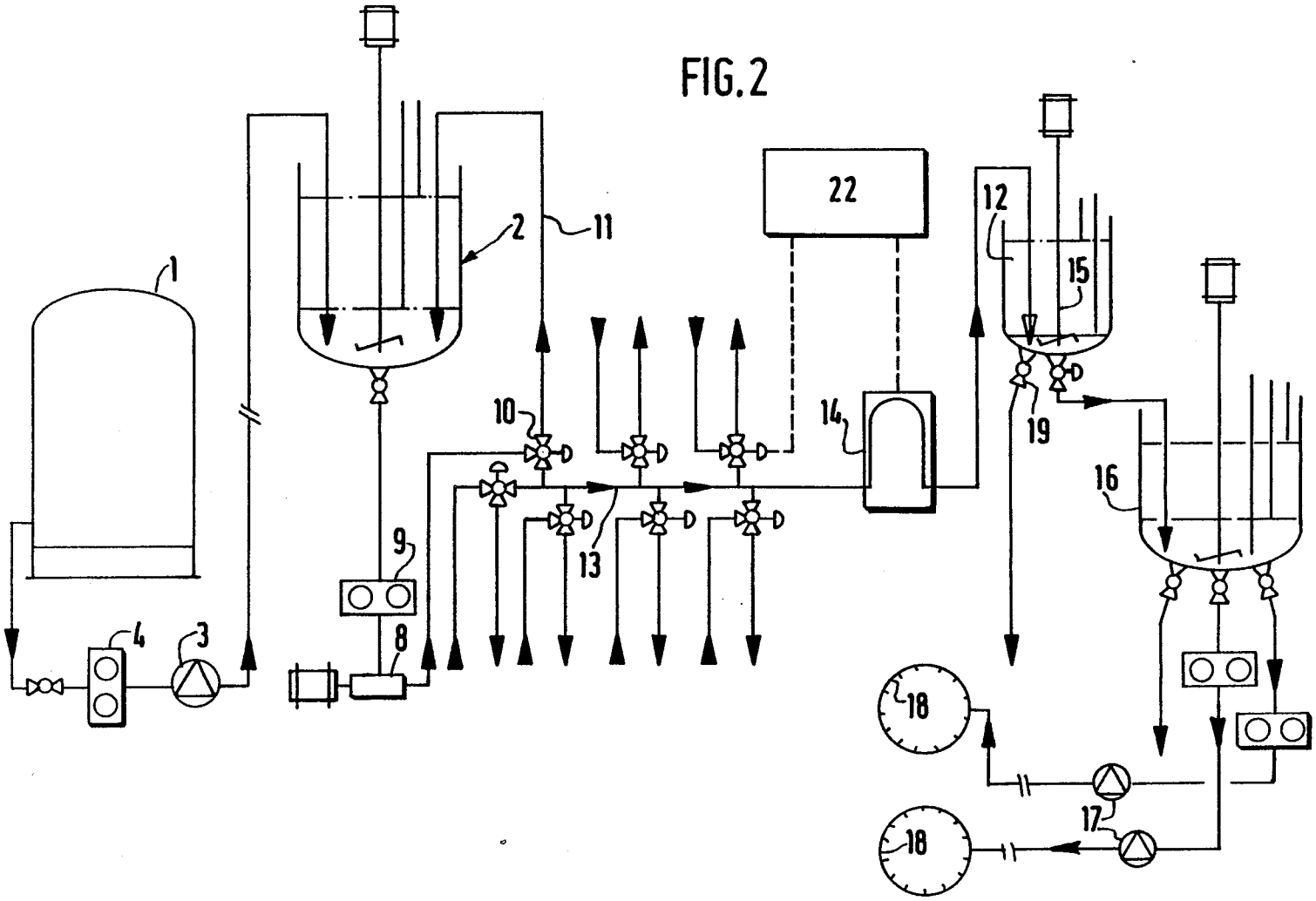
FIG. 2 is a schematic diagram showing a part of the preparation and distribution installation for the adhesive compound according to the invention.

In prior methods and in the method according to the invention, the constituents intended to form the adhesive are stored and taken to utilization tanks in a similar manner.

FIG. 2 shows the part of the installation which corresponds to the storage and transfer of a constituent to the utilization tank. Analogous arrangements are used for each of the constituents under the conditions indicated below for some of them. This part of the installation is not shown in FIG. 1.

The individual constituents (resin, carbamide solution, emulsion, oil, ammoniac, silane hydrolysate. . .) are stored in large capacity tanks (1) in the utilization areas to allow a sufficient autonomy. Especially when the isolated constituents are prepared on the site, the tanks can have a smaller capacity, since risks of running out of supply are smaller.

These tanks (1) are kept under the required conditions for each constituent so as to ensure a clearly defined quality. They are, for example, equipped with homogenization and devices and are thermostatically controlled.

It is obviously preferable to introduce the water needed to complete the compound directly into the circuit at the level of the measuring device discussed below.

It may be preferable to transfer products added in very small proportions directly from their container to the utilization tank (2).

The constituents are each taken to a utilization tank (2) through the use of a transfer pump (3). It can be advantageous to install a filter (4) on the transfer conduit, upstream from the pump, to protect the latter.

During operation, the utilization tank (2) is kept filled between the maximum and minimum levels. Level detectors control the activation of each transfer pump (3). The utilization tank (2) constitutes a convenient small-capacity intermediary in the immediate proximity of the adhesive preparation area. It allows a constant feed to be ensured for the circuits which follow it. Each utilization tank can also feed several preparation complexes if necessary.

When the installation of various elements calls for it, especially when the storage area is close enough to the adhesive preparation area (and thus when the conduit system needed is not too extensive), the circulation loop can be placed directly after the storage tank (1). In other words, the utilization tank (2), the transfer pump (3) and its filter (4) can be eliminated.

The constituent is tapped from the utilization tank to pass into a circuit which leads to a preparation tank.

This circuit is quite appreciably different if one considers the conventional structure shown in FIG. 1 and that according to the invention, an embodiment of which is shown in FIG. 2.

According to the conventional method, the circuit has a set of filters (5) and volumetric dosing pumps (6), which push the constituents, in definite quantities, back into the preparation tank (7) which is common for all constituents and in which they are mixed. The circuit also usually has shutdown valves and drains.

The most precise traditional volumetric pumps are piston pumps whose movement establishes a constant volume. The speed and amplitude of this movement, caused by a connecting rod-crank engine, can be adjusted.

The amplitude or the cycle of the piston correspond to a change in the shape of the rod-crank complex. In addition, although this modification may be controlled automatically as indicated above, this automation requires relatively complex equipment which greatly increases the cost of the installation. For this reason, manual control is often preferred but involves problems inherent in this method, namely slowness of operation, risk of error, etc.

The variation of the speed obtained, for example, using speed variators is not problem-free either. As stated, the operation of the variators is not precise enough to ensure a satisfactory preparation.

The adhesive compound prepared in the tank (7) next passes into a distribution circuit which is presented in detail with respect to the installation according to the invention.

FIG. 2 shows an embodiment according to the invention.

In this installation, the part pertaining to storing the constituents and transferring them to the utilization tanks is as described above. The subsequent part, which is peculiar to the embodiments according to the invention, must be considered in detail.

Each constituent taken from a utilization tank (2) passes into a feed loop which comprises a circulation pump (8), a filter (9) to protect the pump (8) and, located upstream from the latter, a three-way valve (10), a return conduit (11). In this circuit, the operating parameters are determined so that the flow rate of the pump is greater than that required to feed the preparation tank (12) mentioned below. As such, the constituent constantly runs through the feed loop.

Indeed, for the proper operation of the circulation pump (8), it should preferably run continuously. Under these conditions, depending on the position of the three-way valve (10), the constituent is either completely returned to the utilization tank (2) through the conduit (11), or is partially returned and partially sent into the circuit feeding the preparation tank (12).

It is also possible according to the invention to replace the feed loop with a one-way circuit to the utilization tank (2). As such, this method implies that the pump is discontinuous, which is less favorable, especially because of the risks of deenergizing as the result of a even a brief shutdown. Moreover, this also involves a circulation pump flow rate which is relatively similar to the flows actually necessary. On the contrary, in the case of a feed loop, there is a great degree of latitude in choosing the characteristics of the pump, provided that the circulation generated be greater than the necessary flow rate.

According to the invention, it is not necessary to use a pump with a very precisely controlled flow rate. The dosage is not done by the pump, but directly on the amount of constituent circulating in preparation tank (12) feed conduits.

For these reasons, a wide variety of pumps can be used, especially centrifugal pumps, gear pumps, propeller pumps or slide vane rotary action pumps. Since the function of these pumps is not to measure the quantities of the constituents, they can be chosen according to their sturdiness more so than their precision, which allows the reliability of the installation to be improved appreciably and limits the delicate maintenance operations compared to what occurs when following the traditional technique in which the volumetric pump itself does the measuring.

In FIG. 2, the feed loops for the various constituents (only one of them is fully shown) are shown connected to a single circuit to measure and feed the preparation tank (12). This arrangement is advantageous because it makes it possible to greatly simplify the installation. We shall see that it can be preferable to divide this part into two or more [sections]. But, generally, according to the invention, it is not necessary to provide a separate measuring circuit for each constituent while, on the contrary, the most widely used traditional method consists of having a dosage circuit with a volumetric pump for each constituent.

When, as shown in FIG. 2, several connections are made on a same measuring circuit, an effort is made to limit the volumes of the conduits separating the three way valves of the common conduit (13) as well as the length of the common conduit (13) coming before the measuring device (14) as much as possible.

In the installation according to the invention, the constituents are measured by a mass flow meter-type device such as those marketed by the MICRO-MOTION company. These devices operate as described below.

The measured liquid circulates in a U-shaped tube (20) which is given a vibrating movement imposed in a direction located outside of the plane of the U-. The vibration of the tube causes the liquid circulating in the U-shaped tube to accelerate in the direction of arrows a. The instantaneous direction of these vibrations is illustrated in FIGS. 3*a* and 3*b* by arrows V. Conversely, the liquid resists the acceleration imposed on it due to inertia. This resistance creates two forces in opposite directions on each leg of the U, shown by arrows F in FIG. 3*b*. These forces are a direct function of the mass of the liquid circulating in the tube. These forces and subsequently the mass of the liquid are measured by measuring the bending of the tube, which occurs as shown in FIG. 3*b*. The bending is inversely related to the direction of the vibration.

The bends are measured, for example, magnetically.

Mass measurements done using these flow meters has a precision of about 0.5 to 1%, which is totally satisfactory for its use according to the invention. Moreover, has about the same magnitude as that obtained with very high quality volumetric pumps.

We have stated that the same measuring circuit can serve for the various constituents of the adhesive. In practice, the masses of the constituents used to prepare a single adhesive can be very different. This can involve a few problems.

Indeed, the cross section of the mass flow meter is chosen to allow maximum precision for a given flow range. The loading time for each product is determined according to the choice of this range. When constituents are used in very different proportions while using a same flow meter, the time sequences are also very different. This can cause certain problems. If a low flow rate is chosen, the most abundant constituents will take a long time to pass, so that the speed at which the adhesive is used may not be satisfied. If, on the contrary, a high flow rate is chosen, the sequence is rapid and demand is satisfied, but the passage time for small proportion constituents is much less and measurement precision for them can decrease in an undesirable manner, for example, due to the inertia of the valves.

When the adhesive formula contains constituents which are added in very different proportions, it can be advantageous to construct two or more measuring circuits, with each circuit being chosen to correspond to the best measuring conditions corresponding to the products considered.

Of course, it is possible to assemble a measuring circuit for each constituent, but this greatly increases the cost of the installation. The improvement resulting from such an arrangement is generally insufficient to compensate for this additional investment.

It is remarkable that only one measuring device (or, if need be, two) can suffice for all of the various constituents, regardless of their nature. This becomes more advantageous as the number of constituents increases. There are usually 6 to 10, but there can be more. One advantage of mass flow meters is that they operate independently of the volume mass of the products treated. Possible variations are smaller than the general accuracy of the measuring indicated above. Moreover, the volume masses of the various constituents used are essentially similar, which further increases the accuracy of the measurements.

The similarity of by-volume masses of the constituents also prevents the dead volume formed by the conduit located between the three-way valves and the intake of the flow meter from appreciably distorting the measurements made although a fraction of the time period in which a constituent is circulating is used to measure the rest of the preceding constituent filling this part of the circuit. However, it is preferable to limit this dead volume as much as possible by placing the three-way valves as close as possible to the flow meter. Of course, when products having very different volume masses are involved, a systematic correction allows precision to be further increased. For the most common operating conditions and, by following the precautions indicated below, it is nonetheless possible to operate without corrections. In the hyoothesis in which the compounds are prepared automatically according to a programmed control, the systematic correction is advantageously included in the program.

The use of only one flow meter (or a small number of them) in the operation of the installation implies that it receives the products in a sequence to measure them one after the other.

The choice of the sequence is not necessarily arbitrary. It can be determined by the mixture to be made. It can also depend on whether the constituents are made to pass through a common circuit. It is especially preferable to rinse the preceding elements in the sequence once or twice with water at the end of the sequence, which can involve all of the water added or only a fraction of it. As such, each passage of the constituent can be separated by a rinse using a fraction of the water necessary.

Rinsing at the end of the sequence has a twofold interest. On the one hand, it ensures that all of the constituents, the introduction of which was controlled by the opening and closing of the different valves, was indeed transferred to the preparation tank and thus the proportions are respected. On the other hand, in the event of a change in composition from one operation to the next, it ensures that the constituents from the preceding compound are eliminated.

For the same reasons, in the schematic circuit shown in FIG. 2, it is preferable to place the water feed at the end of the conduit 13, so that the wash covers all of this conduit.

The drawing in FIG. 2 shows a feed circuit for the measuring device comprising 7 three-way valves. This is only an example. The number of feeds and consequently the number of different constituents is unlimited. Moreover, since a same installation can serve in the preparation of different types of adhesives, all of the feeds are not necessarily utilized during the sequence for the preparation of a given adhesive.

The constituents placed in the preparation tank are homogenized with an agitator (15). They are next transferred into the distribution tank (16). The command to pass from tank (12) to tank (16) is determined by the level measurement in the latter. When the minimum level detector activates the transfer, the whole preparation in the tank (12) is decanted. This is done either by simple gravity, as shown in the figure, or with a circulation pump. When the tank (12) is emptied, another adhesive preparation sequence is begun.

Provisions are made so that the preparation time is still less than the consumption time for the compound, so that the process continues in an uninterrupted manner. Under this condition, it is seen that a relatively small volume can be prepared in each sequence, which limits the quantities of products immobilized. Even if it requires the multiplication of preparation operations, this method does not involve any measuring problems to the extent where these operations are completely automated, as we will see below.

Moreover, the small volume of adhesive prepared in each sequence allows a more rapid rotation, in other words, a shorter average standby time before a utilization period. This is especially advantageous when the compound prepared changes quickly under surrounding conditions.

The small volume on standby also facilitates changing the adhesive in operation by reducing the time between two successive preparations. As we have indicated, the compound is changed in the case of the invention without interrupting production, by simply changing the constituent feed sequence.

When the compound is changed, the tank (12) is emptied completely. In other words, the fraction of compound which is located under the minimum level is either consumed or removed by the drain (19).

Various methods can be used to distribute the adhesive to the spraying stations. Advantageously, the compound coming from the distribution tank (16) is sent by dosing pumps to the spray devices (18). These dosing pumps must be stable, but they do need to be highly precise.

At this point in the installation, it is not a question of preparing a compound from constituents in highly rigorous proportions, but of coating the fibers forming the felts with a constant amount of the adhesive.

The dosing pumps can also be replaced temporarily or permanently by a volume mass-type measuring complex associated with means to control the flow rate such as proportional valves. If the cost of these devices makes this type of solution less attractive for a permanent industrial application, it can nonetheless present great advantages in the capacity of occasional checks done on the production line.

Propeller pumps, for example (like MOINEAU type pumps) are used to feed the spray devices.

A circulation loop (16) can be installed connecting the distribution tank (16) and the dosing pumps (17). This arrangement, which is not shown in FIG. 2, is useful especially when the distribution tank (16) is relatively far from the place of use and when the type of compound is to be changed frequently. In this case, as above, the circulation loop has a filter, with a circulation pump ensuring a flow rate which is greater than that corresponding to the feed for the dosing pumps (17).

When a circulation loop is used, the measuring of the adhesive distributed can be controlled using simple rotameters regulating controlled-opening electrovalves, or with similar devices.

A considerable advantage of the installation according to the invention presented above is related to the fact that the proportions of each constituent in the compound is controlled without any modifications to the level of the measuring device, contrary to the operating method using dosing pumps. Indeed, according to the invention, materially, the modification of the proportions or the constituents themselves results from a change in the opening and closing sequence for the three-way valves. The mechanical complex is thus unchanged.

This simplification is appreciable when the preparation sequence is operator-controlled. The latter can remote monitor the preparation and intervene instantaneously for urgent modifications. The provisions according to the invention are still more appreciable for automated operation. The latter is increasingly advantageous as production lines are more varied and modified more often.

The automated complex does not require other information inputs than those established in any event, namely, the measuring of the levels of the constituents in the storage tanks and vats, that of the levels in the preparation, utilization and distribution tanks and the information provided by the device(s) which measure the masses of the constituents feeding the product.

Automated or not, the complex also generally has measuring devices which verify that the necessary pressures are present in the circulation loops.

All of this information is sent preferably to a processing complex which also receives programmed instructions. In response, this complex controls the operation of the various elements of the installation: valves, pumps which control the preparation of the adhesive etc. In FIG. 2, the data processing and control complex is represented by the block (22). For example, the connections for the processing complex have been shown in dotted lines, on the one hand, with the measuring device (14), and, on the other hand, with a three-way valve (10). Of course, connections are installed with all of the measuring and control equipment in the installation.

If necessary, the information coming from the various measuring instruments also allows the storage of the constituents of the adhesive compound to be managed by determining the cumulative consumption thereof.

For example, an adhesive preparation utilized for the production of glass fiber felts for insulation includes the following different constituents added in this order:

water,
modified or unmodified formo-phenolic resin,
carbamide in aqueous solution,
ammonium sulfate in solution,
ammonia solution,
oil emulsion,
hydrolyzed silane,
water.

As indicated above, the circulation of water at the end of the sequence allows the feed conduits to be rinsed. The water introduced at the beginning of the sequence allows the proper homogenization of the compound gradually as the different constituents are added. The water introduced on these two occasions can be divided, for example, in half.

In the case of a single measuring device, the constituents are introduced separately.

Like the manual control, the automated control allows not only the following of the introduction of the different constituents in the required proportions, but also allows the total quality of the compound prepared to be modulated. As such, the quantity of the adhesive can be adjusted precisely to the amount necessary when a production change occurs.

The preparation time for the adhesive is adjusted to follow the rate of consumption. Advantageously, a sufficient margin is maintained to allow intervention on the preparation installation. For example, the length of the preparation period is adjusted to half of the consumption cycle.

As we have indicated, the quantity of the adhesive compound prepared for each cycle can be very small. For reasons of convenience and if needed to provide for brief interventions on the installation without having to interrupt production, it is nonetheless preferable for the capacity of the distribution tank to be sufficient so that, between the maximum and minimum levels, the quantity of adhesive corresponds at least to 15 minutes of consumption.

The capacity of the distribution tank is not related to that of the utilization or preparation tank. Of course, the only limit is that the volume of the distribution tank be sufficient to accommodate all of the largest load to be prepared in the preparation tank.

The above described invention for the preparation of adhesives can be used to prepare compounds which are sprayed under the same conditions on fibers, even if the latter are not intended, or are not essentially intended to bond the fibers together. The invention can especially be used to prepare softening compounds whose main role, for example, is to make the fibers pleasant to the touch, or to prevent the emission of dust. In the same manner, a combination of several liquid constituents is used in the preparation of these softening compounds. The same process and the same type of installation as that described for adhesives thus can be utilized.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. Apparatus for the preparation of liquid compounds intended to be sprayed on fleeces or felts made of mineral fiber, with these compounds requiring the combination and mixing of several constituents which are in the liquid state, comprising a preparation container (12) to which the constituents are sent through a given number of conduits (13), the total number of conduits being from 1 to the greatest integer value smaller than the number of constituents, with each conduit (13) being connected by at least one valve (10) to constituent feed equipment, with each valve (10) controlling the sequential introduction of a constituent into said conduit (13), with a mass flow meter-type device being placed on each said conduit (13) downstream from the valves (10), and to a distribution means, to which the compound passes from said preparation container.

2. Apparatus according to claim 1 wherein the constituent feed equipment comprises a utilization container (2), a set of conduits (11) forming a circulation loop on which a circulation pump (8) and a three-way valve (10) are placed, which three-way valve (10), depending on its position, sends all or only part of the constituent to the utilization container, with the other portion, in the latter case being sent towards the conduit (13).

3. Apparatus according to claim 2 wherein the constituent is kept in the utilization container between two levels, minimum and maximum, with detectors activating the delivery of the constituent from storage tanks (1).

4. Apparatus according to claim 1 wherein the mass flow meter-type device (14) allows the constituents to flow so that the compound can be prepared at least twice as quickly as this compound is consumed.

5. Apparatus according to claim 1 wherein the distribution means has a distribution container (16) into which the compound prepared in the preparation container (12) is decanted, then is taken out continuously to be sent to at least one distribution device (18).

6. Apparatus of claim 1 wherein the sequential operation of the valves (10) is controlled by an automatic complex (22) responding to information provided by the mass flow meter (14) and level detectors in the storage preparation, utilization and distribution containers according to stored instructions.

* * * * *